United States Patent [19]

Barauke

[11] Patent Number: 4,593,438

[45] Date of Patent: Jun. 10, 1986

[54] SPINNING MACHINE DRAFTING ROLLER ADJUSTING ARRANGEMENT

[75] Inventor: Norbert Barauke, Donzdorf, Fed. Rep. of Germany

[73] Assignee: Hans and Fritz Stahlecker, Fed. Rep. of Germany

[21] Appl. No.: 657,513

[22] Filed: Oct. 4, 1984

[30] Foreign Application Priority Data

Oct. 4, 1983 [DE] Fed. Rep. of Germany ..... 3336038

[51] Int. Cl.[4] ..... D01H 5/34; D01H 5/56

[52] U.S. Cl. ..... 19/261; 19/294

[58] Field of Search ..... 19/258, 260, 261, 294

[56] References Cited

U.S. PATENT DOCUMENTS

| | | | |
|---|---|---|---|
| 1,182,165 | 5/1916 | Goldsmith | 19/261 |
| 2,271,191 | 1/1942 | Gossett et al. | 19/261 X |
| 2,357,982 | 9/1944 | Thomas et al. | 19/261 |
| 2,885,740 | 5/1959 | Thompson et al. | 19/261 |
| 4,088,016 | 5/1978 | Watson et al. | 19/261 X |

*Primary Examiner*—Werner H. Schroeder
*Assistant Examiner*—Andrew M. Falik
*Attorney, Agent, or Firm*—Barnes & Thornburg

[57] ABSTRACT

In a spinning machine with a plurality of adjacently disposed drawing or drafting roller arrangements with which the lower rollers are arranged as lower roller cylinders extending in the machine longitudinal direction, a central control device and adjusting arrangement is provided for the adjustment of the distance of the lower roller cylinders. The central control device is linked to several locations at a lower roller cylinder or to several bearing seats of a lower roller cylinder, whereby all bearing seats of this lower roller cylinder are loosened at guide holders whereby then the bearing seats and the lower roller cylinder are simultaneously brought into the desired position by activating the control device. When in the adjusted position the bearing seats are again fixedly attached to the guide holders.

18 Claims, 3 Drawing Figures

SPINNING MACHINE DRAFTING ROLLER ADJUSTING ARRANGEMENT

BACKGROUND OF THE INVENTION

The invention relates to an arrangement for adjusting the spacing distance of the lower roller cylinders of a plurality of adjacently disposed drawng or drafting roller units of a spinning machine. The lower roller cylinders of such machines extend in the machine longitudinal direction and are borne in a plurality of bearing positions which each include a bearing seat fixedly attached to a guide carrier, wherein all bearing seats of a lower roller cylinder are detached from the guide carrier during adjustment of the spacing distance. The bearing seats are then jointly moved into the desired position together with the lower roller cylinder, and subsequently again fixedly attached to the guide holder or carrier.

Spinning machines of the kind mentioned above are often used in practice. If a sliver is being spun after a batch change, which sliver is of a different staple length than the previous batch, it is necessary to adjust the clamping distance between the sets of drafting rollers. It is not usually a problem to carry out this adjustment for the upper rollers which are not formed as cylinders extending in machine longitudinal direction, but which are pressure rollers that are arranged as single rollers or as a unit with two adjacently arranged rollers. The adjustment of the spacing distance of the lower roller cylinders, however, creates an extensive amount of work in practice, which task can only be completed by a large number of persons, a so called assembly crew. All bearing seats need to be detached by the persons of the assembly crew whereby the respective lower roller cylinders have to be held by several persons, to be subsequently and evenly returned to the desired position, and again held until the bearing seats are again attached to the guide carrier. This is clearly a time consuming and expensive assembly operation in connection with the resetting or conversion of a spinning machine.

With single drafting roller arrangements of a drafting roller combination of a drawing frame it is known from German Published Unexamined Patent application (DE-OS) 28 52 692 to provide a control device for the adjustment of the clamping distance. With this arrangement the roller bearings arranged on either side of the drawing roller are retained in bearing slides which are slidable on toothed racks. Both the upper and lower rollers are simultaneously moved, while on the other hand each roller pair is moved singly. Such an adjustment arrangement is however not utilized in connection with spinning machines where there is provided a plurality of adjacently arranged drafting units, the lower rollers of which are designed as lower roller cylinders.

SUMMARY OF THE INVENTION

The invention is based upon the problem to produce a device or arrangement for the adjustment of the distance between lower roller cylinders in drafting equipment of a spinning machine, as well as to create a spinning machine with which the adjustment of the distance of the lower roller cylinders is essentially simplified.

This problem is solved in accordance with the invention in that a central control device or adjusting device is provided which at first is coupled in several locations, at the lower roller cylinders, or at several bearing seats of a lower roller cylinder arrangement, whereby all bearing seats of this lower roller cylinder arrangement are detachably connected at the guide carrier and can be brought into the desired position together with the lower roller cylinders by using the adjustment device. After they are brought in to the desired position, they are again connected to the guide carrier.

By this central adjusting device the respective lower roller cylinder section or its bearing seats are held and simultaneously jointly adjusted so that the entire adjustment task can be assumed by a single servicing person if the need arises. A high degree of adjustment accuracy is assured with the joint control device without making necessary any extensive training for the adjustment of distances at the single drafting arrangements.

With an advantageous design of the spinning machine according to the invention, the central control device or arrangement is provided with several connecting elements or means linked to a central drive, which connecting means are attached to several positions distributed over the length of the machine at the respective lower roller cylinder or the respective bearing seats for same. With this construction the machine expense can be additionally reduced since not each of the lower roller cylinder cylinders need be provided with its own control device or arrangement. Only a single central control device or arrangement is provided which is selectively connected to the lower roller cylinder to be adjusted or to the respective bearing seats.

A further advantageous feature of preferred embodiments of the invention is the provision of drive means which are adjustable in the machine longitudinal direction, and to which the connecting means are connected via a reverse guidance in such a manner that they are movably driven transveresly to the machine longitudinal direction. Such a central control device or arrangement is integrated into a spinning machine without an increase in the requirement of space for the drafting roller arrangement or for the entire spinning machine.

A further advantagous feature of preferred embodiments of the invention is the provision of a track extending in the machine longitudinal direction as a drive element, which track is guided parallel to a threaded spindle portion thereof by means of a spindle nut. A very accurate and sensitive control arrangement is obtained with the spindle nut and the threaded spindle which enables an adjustment of the distance of the lower roller cylinder with a high degree of accuracy. A scale indicating the adjustment distance is preferably arranged at the threaded spindle so that adjustment training for operating personnel is unnecessary or very limited. It is further advantageously provided that the threaded spindle and the spindle nut include self-locking threading. It is further advantageous if the threaded spindle is guided out of the machine end at its end face and includes an operating element. The scale mentioned above is then arranged between the operating element and the machine end.

A still further advantageous feature of preferred embodiments of the invention includes the provision of loop-like tension bands as connecting elements about a lower roller cylinder, which bands turn about deflection rollers and are arranged at a spacing to these rollers at the tension track. The tension bands are looped about the lower roller cylinders without the danger of damage. It is thereby advantageous if the tension bands respectively are fixedly connected to the track and attached to a stationary holder or carrier. Thereby a distance overlapping will occur, which means that the actual adjustment distance of the lower roller cylinder is one-half the movement of the track so that the adjustment is very accurate.

A further advantageous feature of preferred embodiments of the invention is the provision that the tension bands are connectable via adjustable fastening means or elements to the stationary holder or carrier. It is thereby possible that the servicing person, after having looped the tension band about the lower roller cylinder, connects the same to the holder or carrier in such a manner that the tensioning bands are evenly tensioned at all positions so that the lower roller cylinder is carried evenly.

Further objects, features, and advantages of the present invention will become more apparent from the following description when taken with the accompanying drawings which show, for purposes of illustration only, a single embodiment in accordance with the present invention.

DETAILED DESCRIPTION OF THE DRAWINGS

Figure 1:
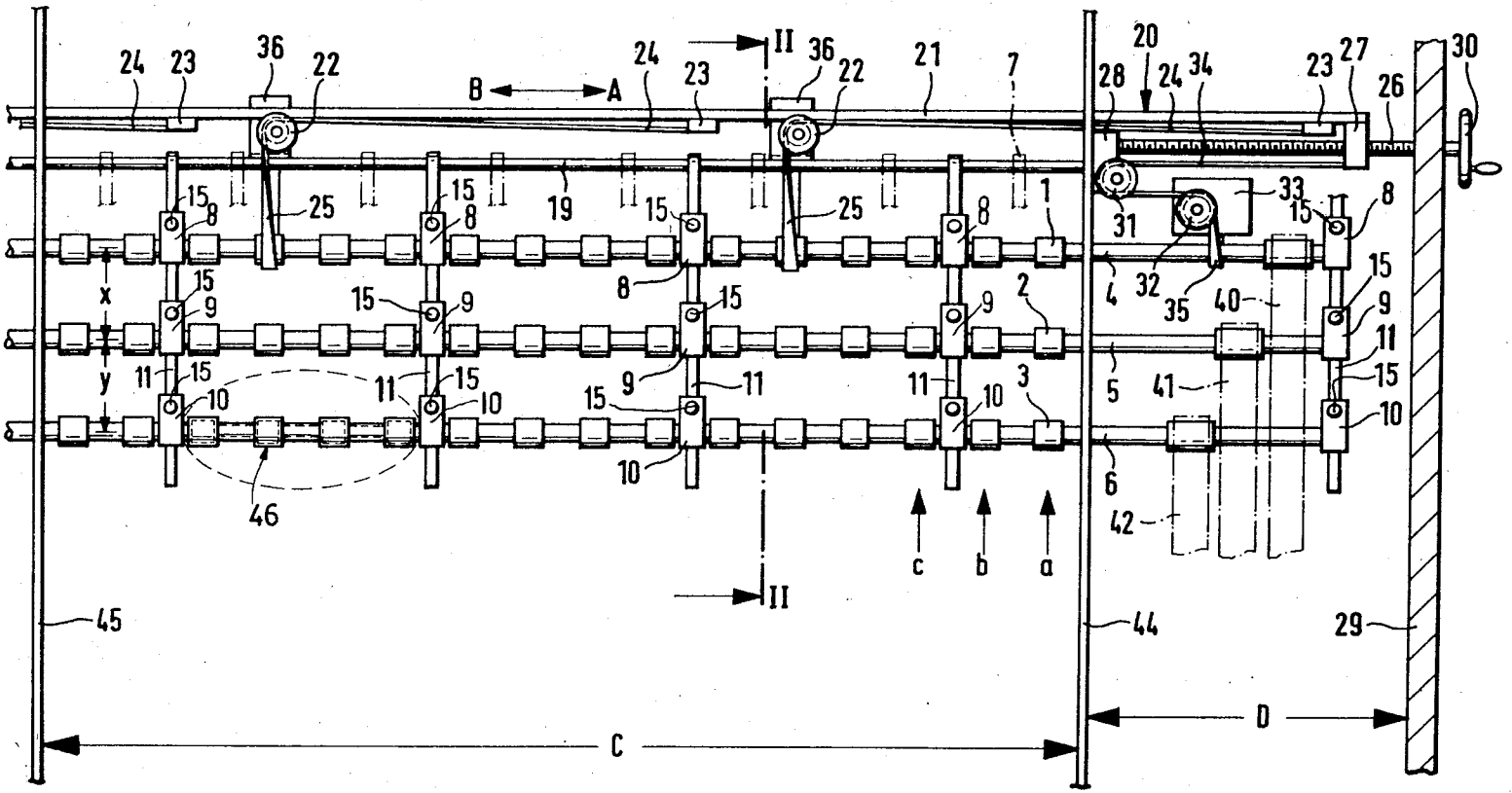
FIG. 1 shows a top view of a spinning machine including a plurality of adjacently arranged drafting roller arrangements in the area of an end section and the machine end, constructed in accordance with a preferred embodiment of the present invention.

The spinning machine shown in FIG. 1, of which only the area of the drafting roller arrangements is shown, includes a plurality of spinning positions a, b, c, . . . of which a greater number is combined respectively in one machine section C which sections C are bordered by frame walls. The entire length of the spinning machine is divided into several such sections C which are bounded by frame walls 44 and 45. Section C as shown herein connects to a drive housing which includes length D in the machine longitudinal direction.

The drafting roller arrangements of spinning positions a, b, c, . . . each contain three lower rollers 2, and 3, whereby certainly other lower rollers can also be provided dependent upon the intended purpose. The lower rollers 1, 2, and 3, are arranged on spindles or shafts 4, 5, and 6 extending and driven in the machine longitudinal direction, which means they are designed as so-called lower roller cylinders. The lower rollers 1, 2, and 3 are drawn in an enlarged diameter for descriptive reasons. In practice, however, usually cylinders are provided which are corrugated or knurled diagonally in the area of the shafts at the lower rollers 1, 2, and 3.

Upper rollers 46 are provided for the lower-rollers 1, 2, and 3 respectively which are so-called pressure rollers shown in FIG. 1. These upper rollers are carried or supported by means of upper roller carrier and weighting arms 7 as shown in FIG. 1 in dotted lines. It should be clear from the here shown position of the upper roller carrier and weighting arms 7 that with the described embodiment, so-called pressure roller twins are chosen, which means two upper rollers which are part of adjacent spinning units respectively are arranged upon a common axle.

Figure 2:
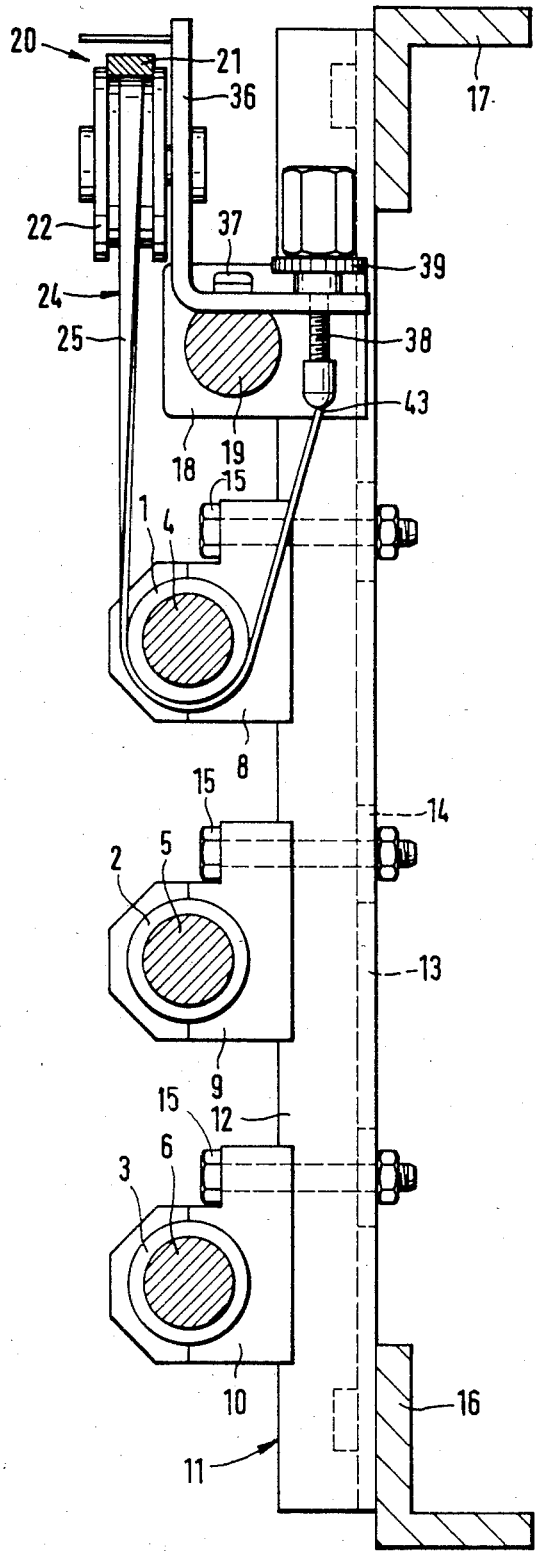
FIG. 2 is a cross sectional view along the line II—II of FIG. 1 in an enlarged scale.

The lower roller cylinder and shaft arrangements 1, 4; 2, 5, and 3, 6 are borne at sequential distances on bearing seats 8, 9, and 10 preferably by means of needle roller bearings. The bearing seats 8, 9, and 10, are respectively attached upon a common guide carrier 11 extending vertically to the machine longitudinal direction, which carrier has a U-shaped or C-shaped profile (FIG. 2). The traverse bar 13 of roller seats 8, 9, and 10 are fixedly attached to machine longitudinal carriers 16 and 17 by means of screws. Said bearing seats 8, 9, and 10 are provided with guide grooves or tracks at the lower side facing the guide carrier 11 and extending vertically to the machine longitudinal direction so that they grab the side 12 of the guide carrier 11 from the outside. Said bearing seats 8, 9, and 10 are fixedly attached to the guide holder or carrier 11 by means of bolts 15. These bolts penetrate the guide holder or carrier in elongated holes 14. The position and the length of the elongated holes 14 is dimensioned such that the distances x and y (FIG. 1) between the lower rollers 1 and 2, as well as 2 and 3, or the distances of spools or shafts 4 and 5, as well as 5 and 6 are adjustable. This adjustability permits to change the drafting roller arrangement for an adjustment to one fiber material with different staple lengths.

The guide carriers 11 are arranged with holders or fasteners 18 which accept a so-called carrier bar 19 extending in machine longitudinal direction and which serve as a pivotable support of the single upper-roller carrier and weighting arms 7.

The distances x and y are changed to accommodate the fiber material to be processed, said distances corresponding to the clamping distances. No greater effort is needed to adjust the distances of the corresponding upper-rollers since these are not cylinders rotating in machine longitudinal direction. Previously the adjustment of the lower roller cylinder arrangements 1, 4; 2, 5, and 3, 6 required an extensive amount of work which is essentially reduced by the central control device 20 provided in accordance with the described embodiment of the present invention.

The central control device 20 includes a connecting rod or track 21 which is arranged approximately in the plane of the lower roller cylinders 1, 4; 2, 5,; and 3, 6 above the same. The connecting rod 21 protrudes into the drive housing and is there provided with a spindle nut 27 arranged upon a threaded spindle 26 which extends parallel to the connecting rod 21 in the area of the drive housing. This threaded spindle is borne in the end wall 29 of the drive housing and in the support or frame wall 44 by means of bearing 28. The spindle nut 27 is secured against a distortion or twisting in a manner not further illustrated here so that a twisting of the threaded spindle 26 leads to a transverse movement of track 21 in the direction of arrows A and B, which means in the machine longitudinal direction. The threaded spindle 26 protrudes through the housing end wall and is provided with a control element, for example, a hand wheel 30. Track 21 is positioned upon several rollers 22 which exhibit a ring groove so that the track 21 can also be guided laterally. Rollers 22 respectively are borne in an angle-shaped holder or carrier 36 fixedly attached to a carrier bar 19 by attaching means 37.

Pulley or tension bands 24 are coupled to the track 21 in predetermined distances by means of holders or fasteners 23 which bands extend first parallel to the track 21 to then partially circumvent the rollers 22; which rollers serve at the same time as deflection rollers.

These bands 24 are wound about the lower roller cylinder arrangement 1, 4 with a loop 25 in the embodiment described herein. The ends 43 of the bands 24 are respectively provided with a threaded bolt 38 (FIG. 2) which extends through a recess of the holder 36 and is screwed upon the same by means of a knurled nut 39. By fastening this nut 39, the loop 25 of the band 24 respectively is pretensioned in such a manner that the bands 24 are fully and tightly engaged at the lower roller cylinder arrangement 1, 4 so that all bands 24 equally and jointly carry the same.

The length of the band 24, the arrangement of holder 23 at the track 21 in distance to the rollers 22, as well as the length of the threaded spindle 26 are disposed in such a manner that subsequent to a corresponding pre-adjustment of the track 21 by means of shifting the spindle nut 27 upon the threaded spindle 26, the bands 24 respectively are chosen and looped about one of the lower roller cylinder arrangement 1, 4; 2, 5, or 3, 6. It is thereby understood that as a rule an adjustment of the lower roller cylinders 3, 6 are unnecessary (i.e. adjustment of lower roller cylinders 1, 4; and 2, 5 is sufficient to adjust spacings x and y).

The spindles 4, 5, and 6 are driven in the drive housing via synchronous belt drives 40, 41, and 42 which each include a tension roller. In a similar manner as in the area of the spinning position a, b c, . . . the spindles 4, 5, and 6 are held upon a guide holder or carrier 11 by means of bearing seats 8, 9, and 10. In order to also accommodate an adjustment in the area of the drive housing, a pulley or tension band 34 is coupled to the spindle nut 27 which is looped about two deflection rollers 31 and 32 arranged in the drive housing, and which is connected to a holder or carrier 33 by forming a loop 35. Said connection corresponds to the one in FIG. 2 via a threaded bolt 38 and a knurled nut 39.

If, for example, the clamping distance "x" between the lower rollers 1 and 2 of the drafting roller arrangement is to be changed, the bands 24 are then looped about the sub-roller cylinder 1, 4 and tensioned corresponding to the description according to FIGS. 1 and 2. The band 34 is also extended about the spindle 4 in the area of the drive housing and subsequently tensioned. Afterwards all bearing seats 8 of the lower roller cylinders 1, 4 are loosened by partially opening the bolts 15 including the bearing seat 8 in the drive housing itself. The threaded spindle 26 is then operated via the hand wheel 30 so that the track 21 is moved and the bands lifted or lowered corresponding to the desired position of the lower roller cylinders 1, 4. In an advantageous embodiment, a scale is provided in the area of the hand wheel and the housing end wall 29, with which the distance of adjustment and thereby the change in the clamping distance x is directly readable. After the adjustment of the desired distance, the bearing seats 8 are again secured by fastening the bolts 15. Thereafter the bands 24 and 34 are loosened, thereby completing the adjustment process. It might become necessary to further adjust a tensioning roller of the synchronous belt drive 40 corresponding to the adjustment made with regard to the clamping distance x. The bands 24 and 34 are then again loosened and removed from the area of the lower roller cylinders 1, 4. It is thereby sufficient to only loosen the ends 43 and to subsequently position the pulley bands 24 and 34 in such a position where they do not disturb the operation.

In a corresponding manner the lower roller cylinders 2, 5, and 3, 6 are adjusted whereby as a rule one of the two lower roller cylinders 2, 5, or 3, 6 need not be adjusted. The threaded spindle 26 and the bands 24 and 34 are dimensioned accordingly long so that they can be connected to each of the lower roller cylinders 1, 4; 2, 5, and 3, 6 without making an exchange necessary.

Figure 3:
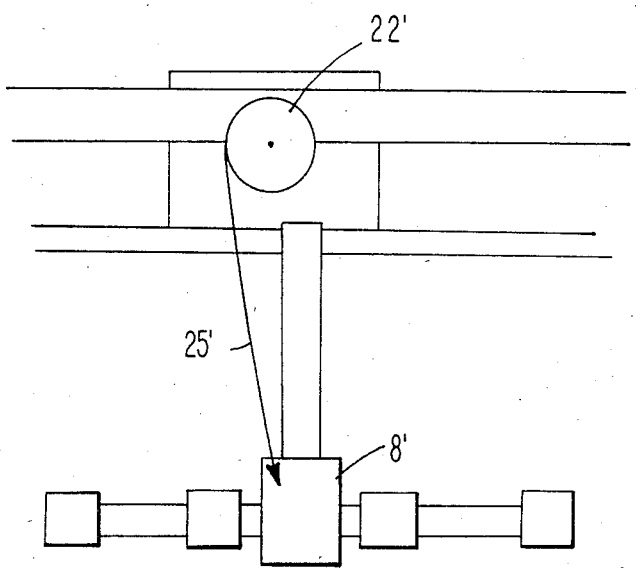
FIG. 3 is a schematic partial view depicting a modified embodiment of the invention.

FIG. 3 schematically depicts a modified arrangement wherein the belt 25' engages a bearing block 8' for adjustably moving same with the belt extending over a pulley 22' in much the same manner as described above for the belts 25 engaging at the roller cylinders.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Spinning machine having a plurality of drafting apparatusses for drafting sliver to be spun, each drafting apparatus comprising a plurality of upper and lower drafting roller means arranged in pairs, said pairs being spaced from one another in the travel direction of sliver being drafted thereby, said lower drafting roller means including:

at least three lower drafting roller cylinder means extending in a machine longitudinal direction transverse to the sliver travel direction, a plurality of in the machine longitudinal direction spaced bearing seats for each of said at least three lower drafting roller cylinder means, bearing seat attaching means for detachably fixedly attaching said bearing seats to respective guide carrier means such that the bearing seats together with the respective lower drafting roller cylinder means can be moved along the carrier means to adjust the spacing between said at least three lower drafting roller cylinder means, and central control device means including linking means engageable at a plurality of longitudinally spaced positions of said lower drafting roller cylinder means to facilitate simultaneous adjusting movement of said at least three lower drafting roller cylinder support means with respect to each other and in the travel direction of sliver.

2. Spinning machine according to claim 1, wherein said bearing seats are slidably guided at the respective guide carrier means.

3. Spinning machine according to claim 2, wherein the central control device means is provided with linking means in the form of several connecting elements connected to a central drive, which connecting elements are assigned to several positions distributed over the length of the machine at the corresponding lower drafting roller cylinder means.

4. Spinning machine according to claim 3, further comprising a deflection guide, wherein the central control device means includes a drive element adjustable in the machine longitudinal direction, to which the connection elements are connected via said deflection guide in such a manner that they extend transverse to the machine longitudinal direction.

5. Spinning machine according to claim 3, wherein the linking means includes tension bands provided as connecting elements, said tension bands being loopable around one of the lower drafting roller cylinder means said tension bands being guided about deflection rollers and being linked to a movable tension guide track at a spacing from rollers for the guide track.

6. Spinning machine according to claim 5, wherein the tension bands are coupled about the rollers upon which the track is guided.

7. Spinning machine according to claim 5, further including a stationary holder, wherein the tension pulley bands are tightly connected respectively with the tension guide track and are connectable with said stationary holder.

8. Spinning machine according to claim 7, wherein the tension bands are connectable to the stationary holder via adjustable fastening means.

9. Spinning machine according to claim 8, wherein the ends of the tension bands are provided with threaded bolts which are screwed upon the stationary holder or fastener.

10. Spinning machine according to claim 4, wherein the drive element is a track extending in the machine longitudinal direction, which track is guided with a spindle nut upon a threaded spindle arranged parallel thereto.

11. Spinning machine according to claim 10, wherein the threaded spindle and the spindle nut are provided with a self-locking thread.

12. Spinning machine according to claim 10, wherein the threaded spindle protrudes with its end face out of the machine end and is provided with an operating element.

13. Spinning machine according to claim 10, wherein the track is guided by rollers at several locations.

14. Spinning machine according to claim 12, wherein said operating element is a manually operable operating wheel.

15. Spinning machine according to claim 1, wherein said linking means includes a plurality of flexible tension band means which are loopable about one of said lower drafting roller cylinder means and are connected to a movable control element.

16. Spinning machine according to claim 15, wherein said movable control element is a guide track which is movable by threaded means in the longitudinal direction of the machine.

17. Spinning machine according to claim 15, wherein said tension band means are selectively loopable about one of the lower drafting roller cylinder means for accomodating their respective adjusting movement.

18. Spinning machine according to claim 1, wherein said linking means is engageable at said bearing seats of said lower drafting roller cylinder means.

* * * * *